US005311701A

United States Patent [19]

Psaros

[11] Patent Number: 5,311,701

[45] Date of Patent: May 17, 1994

[54] CHILD WINDOW GUARD

[76] Inventor: George C. Psaros, 135 Lincoln Rd., Rockland, Mass. 02370

[21] Appl. No.: 137,262

[22] Filed: Oct. 18, 1993

[51] Int. Cl.[5] ..... E06B 3/68

[52] U.S. Cl. ..... 49/57; 160/105

[58] Field of Search ..... 49/50, 56, 57, 61, 463; 160/105, 104; 454/221, 224, 278

[56] References Cited

U.S. PATENT DOCUMENTS

| | | | |
|---|---|---|---|
| 242,180 | 5/1881 | Bartle | 160/105 |
| 1,428,074 | 9/1922 | Brabant | 49/57 X |
| 1,509,569 | 9/1924 | Swanson | 160/105 |
| 1,591,078 | 7/1926 | Biddle | 49/57 X |
| 1,948,230 | 2/1934 | Bayley | 49/50 X |
| 2,852,071 | 9/1958 | Smith | 160/104 |
| 2,928,334 | 3/1960 | Van DeVeire | 49/57 X |
| 4,059,923 | 11/1977 | Sauer | 49/57 |
| 4,573,285 | 3/1986 | Jokel | 49/57 X |

*Primary Examiner*—Peter M. Cuomo
*Assistant Examiner*—Jerry Redman
*Attorney, Agent, or Firm*—William Nitkin

[57] ABSTRACT

A child window guard for installation in an open window, such window guard having a base member positioned on the window sill, a lower window sash receipt member and a plurality of vertical members, such vertical members attached at their bottoms at an outward angle to the base member and attached at their tops to the base of the lower window sash receipt member in which lower window sash receipt member the bottom rail of the lower window sash in received.

7 Claims, 3 Drawing Sheets

CHILD WINDOW GUARD

BACKGROUND OF THE INVENTION

1. Field of the Invention

The invention herein resides in the area of window guards and more particularly relates to a structure that fits in an open window to prevent children from falling out of such open window, such structure having a plurality of aligned vertical members which are angularly disposed between the inner side of the window sill and the raised bottom rail of the lower window sash.

2. Description of the Prior Art

A serious problem exists when a young child gains access to an open window or an open window with a loosely fitting screen as the child can accidentally fall therethrough. A child falling out an open window is especially serious when such window is located above the first floor of a building. In order to prevent such accidents window guards can be utilized. In the prior art such window guards have frequently taken the form of security-type devices such as window grills which are made of heavy metal bars which are securely attached across such windows. Such guards, though, are designed for preventing unlawful entry therethrough and as such can be very difficult to remove in case of fire. Such heavy bars also prevent access into the premises by firemen and other emergency personnel. Further, such devices are often not only quite expensive and heavy but also require extensive installation procedures using permanent bracket attachments. Prior art window guards which are designed to be both removable and collapsible, having extensive and complicated structures to allow their retraction from the window area, are exceedingly expensive.

SUMMARY OF THE INVENTION

It is an object of this invention to provide a lightweight, easy-to-install and inexpensive child window guard which can be quickly installed in an open double-hung or single-hung window to prevent young children from falling out of such open window.

The device of this invention incorporates a plurality of vertical members. Such vertical members can be bars, hollow rods or other beam shapes. For the purposes of illustration only such vertical members are referred to as bars herein. The bars are disposed adjacent to one another across the opening of the window and are each attached at their bottoms to the inner side of a base member. The bars are disposed at an angle of approximately 80 degrees outward from the base member. The base member is positioned on the window sill of the window. The base member on its outer side has a downwardly extending base lip which catches on the outward-facing portion of the window sill against which the bottom rail of the lower window sash closes. The top of each bar is attached to the base of a window receipt channel member and when the lower window sash is raised, the bottom rail of the lower window sash is lowered into the window receipt channel member. Because the bars are attached at an angle to the base of the window receipt channel member, the length of each bar is greater than the height at which the lower window sash is raised above the window sill so that the angularly disposed bars cannot be forced outward by a child because such action would force the bottom of the bars into the window sill. Since the bottoms of the bars and their attached base member cannot pass through the solid material of the window sill, the bars are securely retained by merely having the bottom rail of the lower window sash lowered and positioned within the window receipt channel member of this invention. The downwardly extending base lip at the outer side of the base member prevents the device of this invention from being pulled inward.

The device of this invention is installed by first raising the lower window sash and positioning the device's base member on the window sill with the base member's downwardly extending base lip disposed within the window sash receipt area of the window. One or more screw members can be used to securely attach the base member to the window sill, if desired. Then, by maneuvering the bars which can have some flexibility to them, the window receipt channel member is disposed beneath the bottom rail of the lower window sash which bottom rail is then lowered into the window receipt channel member. The raised bottom rail of the lower window sash, being at the top of the bars is high up out of the reach of small children and such children, because of the lower window sash's height and weight, are unable to raise the lower window sash further to disengage it from the window receipt channel member. Moreover, the narrow spacing of the parallel bars across the open window, being just several inches apart from one another, prevents a child from squeezing therethrough. Although the device of this invention can be constructed of lightweight materials, it possesses sufficient strength to withstand the impact of a small child thereagainst. The design of the device, however, allows an adult to quickly remove the window guard should there be a fire or other emergency, by raising the lower window sash and disengaging its bottom rail from the window receipt channel member and pulling the guard out of the window or, if the guard is attached by a screw or screws, then pulling the device of this invention 180 degrees inward and bending it downward to be aligned with the inner wall below the window.

The device can be made of any strong, lightweight materials which would give it sufficient strength and rigidity to accomplish its purposes which materials include metals such as aluminum and the like as well as various plastics.

DESCRIPTION OF THE PREFERRED EMBODIMENT(S)

Figure 1:
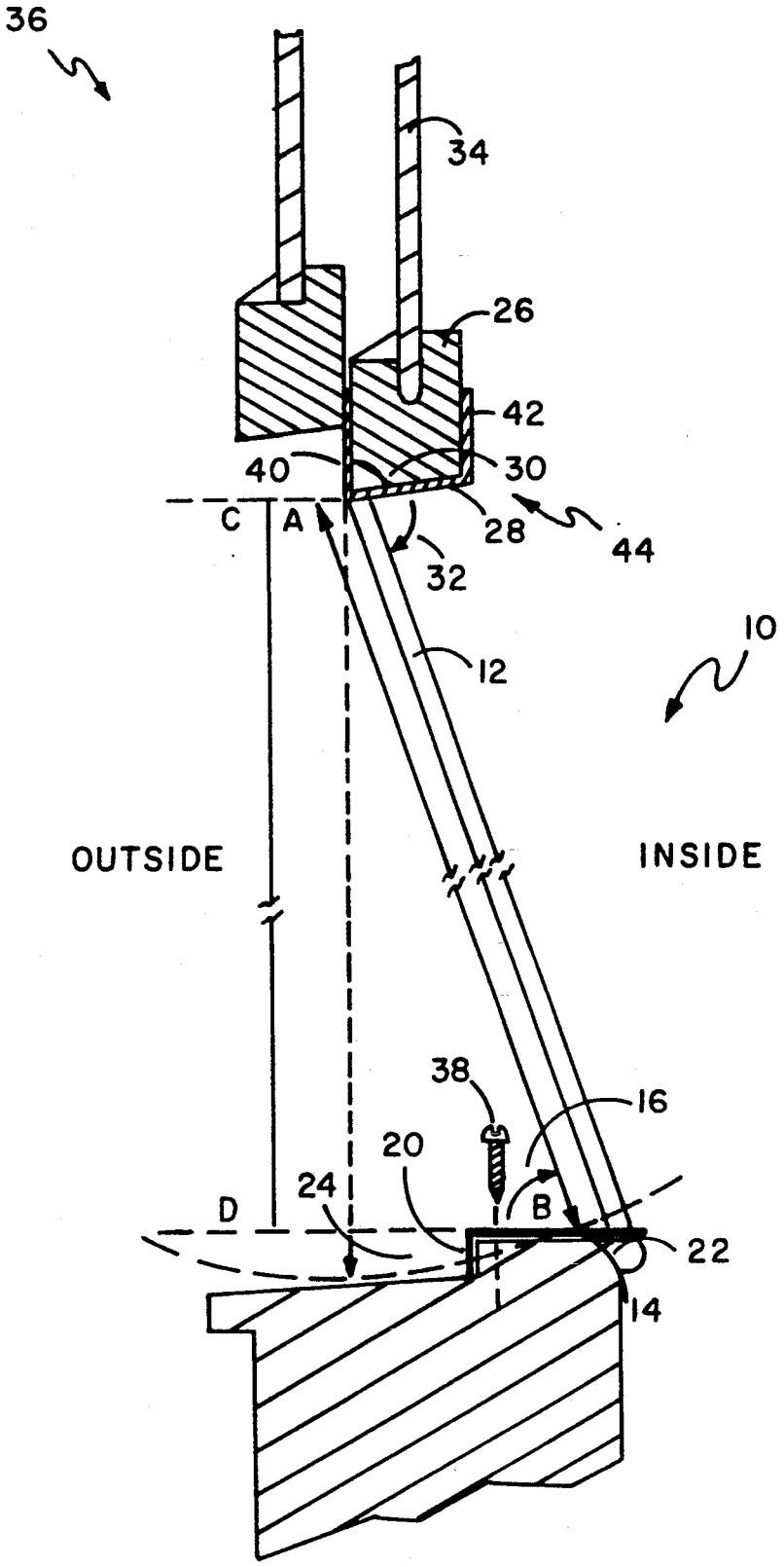
FIG. 1 illustrates a cross-sectional side view of the the child window guard of this invention installed between a window sill and bottom rail of a raised lower window sash of a double-hung window.
Figure 2:
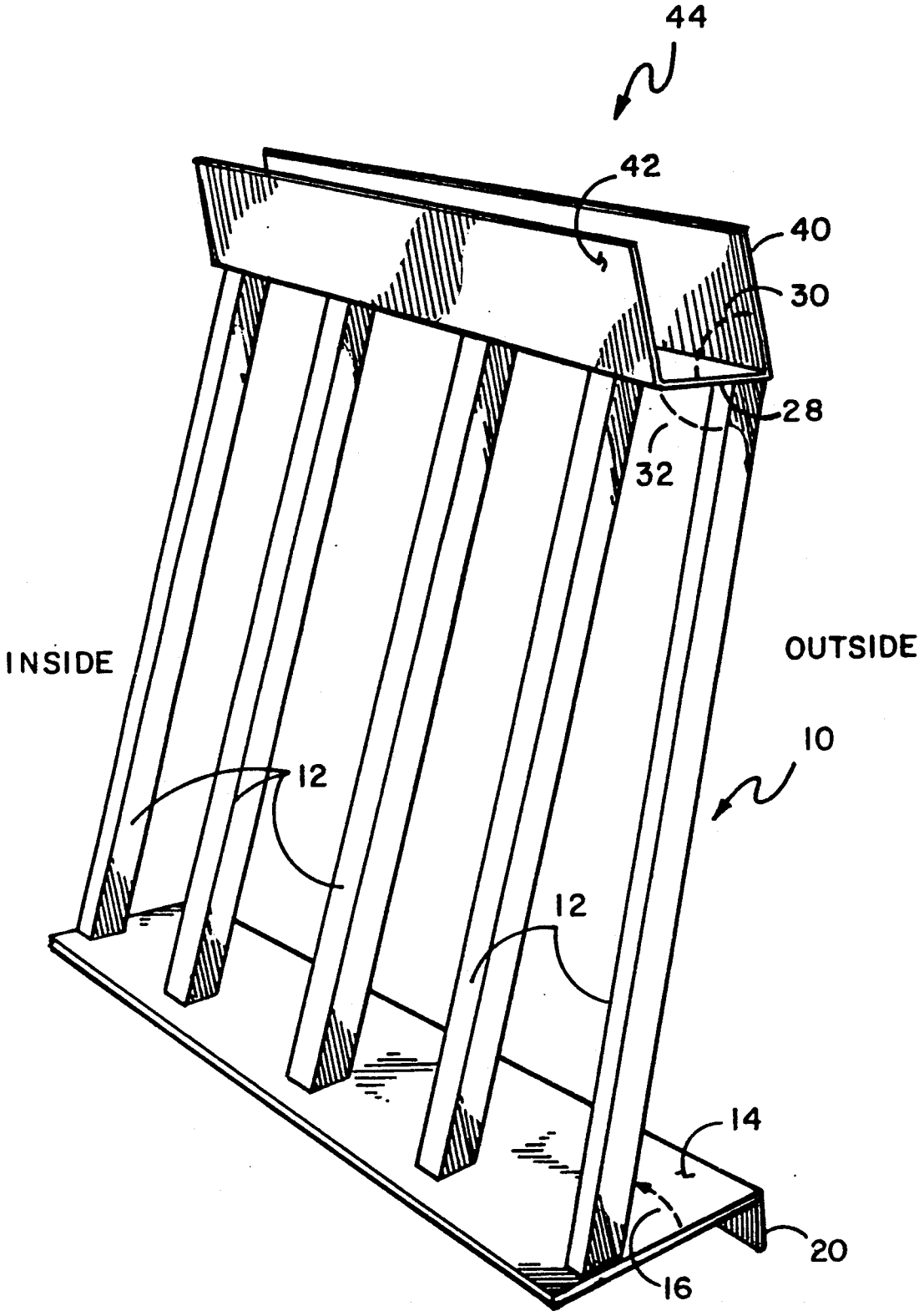
FIG. 2 illustrates a front perspective view of the device of this invention.

FIG. 1 illustrates a cross-sectional view of the child window guard of this invention installed within an open, double-hung window. Window guard 10 is shown with its base member 14 positioned upon window sill 22 with base lip 20 extending downward and disposed within the window sash receipt area of the window sill such that when base member 14 is properly positioned, it cannot be pulled toward the inside of the room. One or more screws 38 or equivalent retention means can pass through corresponding aperture(s) formed within base member 14 to help retain the base member in place, if desired. Each bar 12, as also seen in FIG. 2, extends upward and outward at angle 16 to the base member which angle in a preferred embodiment can be approximately 80 degrees. The top of each of the plurality of bars 12 is attached to base 28 of window channel receipt member 44. Window receipt channel member 44 in a preferred embodiment is a U-shaped channel having outer side 40 and inner side 42, as also seen in FIG. 2, although other equivalent bottom rail retention means can be utilized. The angular disposition of the plurality of bars 12 to the base of the window receipt channel member 44 and to base member 14, provides for the secure positioning and immovability of window guard 10 of this invention in its use mode. Because angle 16 is approximately 80 degrees, corresponding angle 32 is approximately of the same degree or greater since in some cases the window receipt channel base 28 can be disposed at an angle to match the angle of the bottom of the bottom rail of the lower window sash which can be at an angle to mate against the bottom of the window sash receipt area of the window sill which can be at a slight outward and downward angle for the drainage of water therefrom. The length A–B of bars 12 is greater than the height C–D at which the lower window sash is raised above the window sill, as seen in FIG. 1. This difference in length prevents the bars from being forced outwards to the outside, as seen by the inscribed arc in FIG. 1, since such outward movement would force the bars and attached base member downward into window sill 22.

Figure 3:
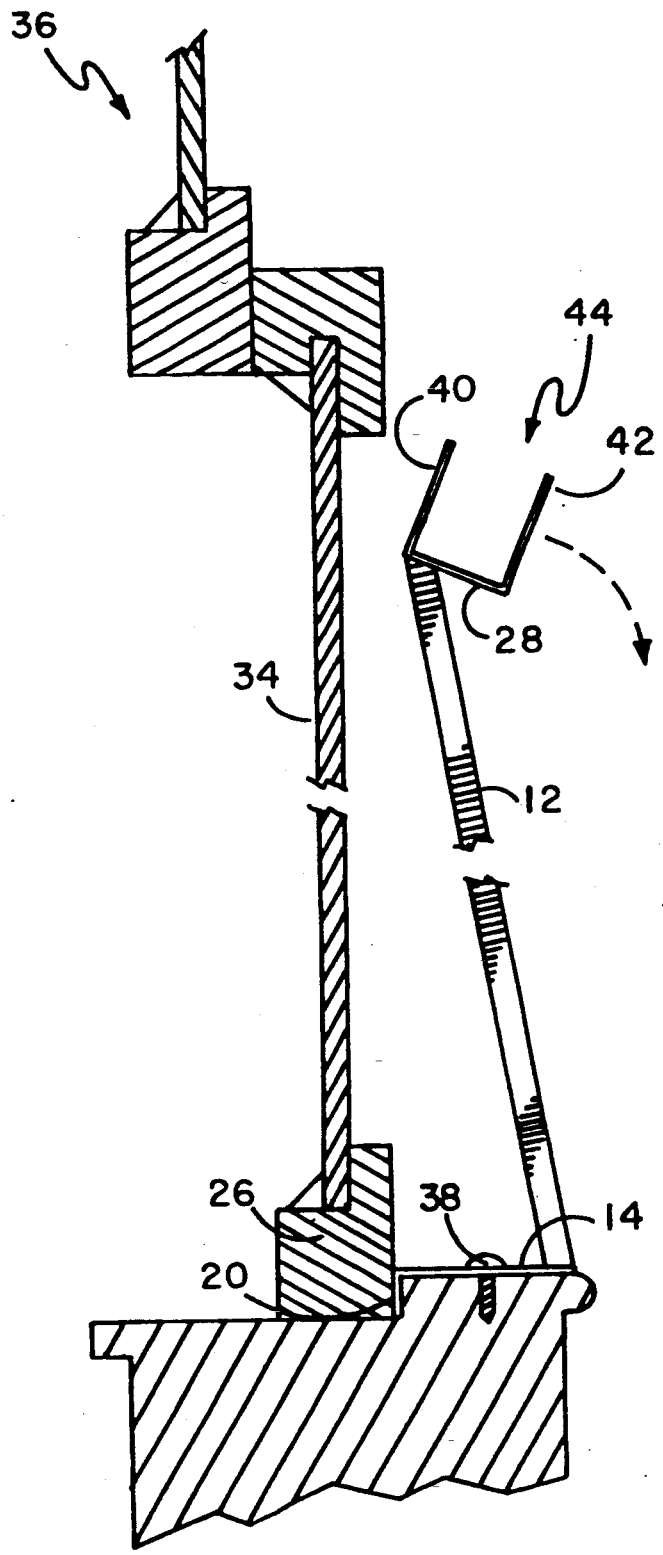
FIG. 3 illustrates a cross-sectional side view of the device of this invention in its non-use mode when the lower window sash is closed.

In order to install window guard 10, the lower window sash with glass pane 34 disposed therein is raised, and the base member of the device is positioned on the window sill. The window receipt channel member 44, which has some flexibility to be moved inward and outward due to the flex of the bars, is positioned below bottom rail 26 of the lower window sash which bottom rail is then lowered into window receipt channel member 44. If one wishes to remove an installed device of this invention, one would raise the lower window sash so that its bottom rail 26 can be lifted out of window receipt channel member 44, thereby freeing the top of window guard 10. One can then aft the bars and attached base member 14 off window sill 22. If one or more screws are utilized, they would be removed first. If one wished to close the window and place the device in its non-use mode and not remove window guard 10, one would free the top of the window guard as described above, pull the window receipt channel member toward the inside of the room due to the flex of the bars and simply close the lower window sash, as illustrated in FIG. 3, until its bottom rail is positioned within window sash receipt area 24. The device of this invention can be left in place in its non-use mode with its base member positioned on the window sill until it is desired to use the window guard again.

FIG. 2 illustrates a front perspective view of the basic structure of this invention showing the positioning of the bars relative to window receipt channel member 44 and showing the angle 16 of attachment of bars 12 to base member 14 and the angle 32 of attachment of the bars to window receipt channel member base 28. Also seen in this view is the acute angle 30 of attachment of outer side 40 to window receipt channel member base 28 which configuration can correspond to the angular configuration of the base of the bottom rail of the lower window sash. Angles 16, 30 and 32 are variable depending upon the nature and configuration of the window in which the device of this invention will be installed, but the window receipt channel member must be large enough to receive bottom rail 26 of the lower window sash therein. Although the window receipt channel member is illustrated as a U-shaped channel, other equivalent retention means can be utilized to receive the bottom rail therein.

The device can be constructed, as mentioned above, of a lightweight, thin-gauge metal, such as aluminum, or plastic having flexibility yet sufficient rigidity to prevent a child from forcing himself between bars 12. Bars 12 can be hollow rods, channel beams or other equivalent shapes to meet the above-mentioned performance requirements and can be produced in various lengths and bar heights. The installation of the window guard of this invention does not interfere with the use of screens.

Although the present invention has been described with reference to particular embodiments, it will be apparent to those skilled in the art that variations and modifications can be substituted therefor without departing from the principles and spirit of the invention.

I claim:

1. A window guard to be used in a window having a window sill, window sash receipt area, and a lower window sash raisable to a height above said window sill, said lower window sash having a bottom rail, said window having an inner side and an outer side, comprising:

a plurality of vertical members, each having a length, a top and a bottom, said vertical members spaced apart from one another;

a base member having an inner and outer side positioned on said window sill, said bottoms of said vertical members attached to said inner side of said base member at an angle, said vertical members extending upwards and outwards from said window sill;

means for preventing inward movement of said base member; and bottom rail retention means attached to said tops of said vertical members to retain said bottom rail of said lower window sash, said vertical members disposed in a non-perpendicular relationship to said base member and to said bottom rail retention means.

2. The device of claim 1 wherein said means for preventing inward movement of said base member comprises a downwardly extending base lip disposed at said outer side of said base member and engaged into said window sash receipt area of said window sill.

3. The device of claim 2 wherein said bottom rail retention means comprises a window receipt channel member having a window receipt channel member base, a channel outer side and a channel inner side into which said bottom rail is lowered and positioned, disposing said vertical members such that the length of each of said vertical members is greater than the height at which said lower window sash is raised from said window sill.

4. The window guard of claim 3 further including:

at least one aperture defined in said base member; and at least one screw member inserted through each of said aperture(s) to screw and attach said base member to said window sill.

5. The window guard of claim 3 wherein said window receipt channel member base is disposed at an acute angle to said channel outer side.

6. The window guard of claim 3 wherein said vertical members are positioned parallel to one another.

7. The window guard of claim 3 wherein said bottoms of said vertical members are attached to said inner side of said base member at an angle of approximately 80 degrees.

* * * * *